US005235943A

United States Patent [19]

Fiorenza, II

[11] Patent Number: 5,235,943

[45] Date of Patent: Aug. 17, 1993

[54] STARTING SYSTEM FOR INTERNAL COMBUSTION ENGINES

[75] Inventor: John A. Fiorenza, II, Slinger, Wis.

[73] Assignee: Briggs & Stratton Corporation, Wauwatosa, Wis.

[21] Appl. No.: 898,028

[22] Filed: Jun. 12, 1992

[51] Int. Cl.[5] ..... F02D 31/00; F02N 17/08

[52] U.S. Cl. ..... 123/179.18; 123/361; 123/376

[58] Field of Search ..... 123/179.18, 361, 376, 123/398, 179.16

[56] References Cited

U.S. PATENT DOCUMENTS

| | | | |
|---|---|---|---|
| 3,744,470 | 7/1973 | Clarke et al. | 123/198 DB |
| 3,749,069 | 7/1973 | Reese | 123/376 |
| 3,752,141 | 8/1973 | Charron et al. | 123/198 DB |
| 3,800,755 | 4/1974 | Klaiber et al. | 123/361 |
| 3,960,130 | 6/1976 | Peterson, Jr. | 123/179.18 |
| 4,517,942 | 5/1985 | Pirkey et al. | 123/376 |
| 4,773,362 | 9/1988 | Wissmann et al. | 123/398 |
| 4,773,371 | 9/1988 | Stenz | 123/376 |
| 4,884,541 | 12/1989 | Marriott | 123/361 |
| 4,915,074 | 4/1990 | Arai | 123/361 |
| 4,938,190 | 7/1990 | McCabe | 123/399 |

*Primary Examiner*—Andrew M. Dolinar
*Attorney, Agent, or Firm*—Andrus, Sceales, Starke & Sawall

[57] ABSTRACT

The starting system allows small engines having electronic governors to be powered by an alternator, thereby eliminating the need for a battery or a manually-operated start lever. The starting system causes the throttle to be in the Wide Open Throttle position at engine starting speeds. The starting system disengages at engine running speeds above about 1200 RPM. The starting system includes a pivotable lever arm, a spring that biases the lever arm in a first direction, and a centrifugally-responsive flyweight assembly that moves the lever arm in the opposite direction. At engine starting speeds, the spring force is greater than the opposing force applied by the flyweight assembly, causing the lever arm to engage a governor arm and to open the throttle to the Wide Open Throttle position. At engine running speeds, the opposing force increases and overcomes the spring force. At that point, the lever arm disengages from the governor arm, allowing the governor to position the throttle without interference from the starting system.

7 Claims, 2 Drawing Sheets

STARTING SYSTEM FOR INTERNAL COMBUSTION ENGINES

BACKGROUND OF THE INVENTION

This invention relates to internal combustion engine. More particularly, this invention relates to starting systems for engines having electronic governors.

It is desirable to use electronic governors in small internal combustion engines to keep the engine running near a set or governed speed. Since electronic governors require a source of electrical power to operate, a battery has typically been used to power the electronic governor. The electronic governor typically powers a stepper motor which in turn changes the throttle position through a linkage. However, a battery is expensive and thus greatly increases the cost of a device that is powered by the small internal combustion engine, such as a lawnmower, snowblower, generator or the like.

Several attempts have been made to eliminate the battery and to use regulated power generated by an alternator to power the electronic governor. None of these devices has been successfully commercialized, however, due to certain problems inherent in their designs.

One major problem with such designs is that they do not allow the engine to have a Wide Open Throttle (WOT) at engine starting speeds since the alternator is generating insufficient power at such speeds to enable the governor to open the throttle to the Wide Open Throttle or "Start" position.

Since electronic governors typically have a return spring which moves the throttle plate to the idle (closed) position when the engine is shut off, an electronic governor that is powered by an alternator must be able to start at closed throttle. However, small internal combustion engines are typically designed to start at the Wide Open Throttle position. Thus, either a battery is required to place the throttle in the WOT position, or the operator must manually move a lever to open the throttle to the WOT position before engine starting.

Both of these proposed solutions are unsatisfactory. The use of a battery, as explained above, greatly increases the cost of the device. The requirement that the operator manually open the throttle to the WOT position is also unsatisfactory since the engine will not start if the operator forgets to open the throttle. Also, the manual system could be unsafe if the operator fails to thereafter move the lever to a running position from the WOT position. In that event, the lawnmower would continue to run at Wide Open Throttle, potentially damaging the engine components.

Another possible solution could be to have the engine run at Wide Open Throttle at engine running speeds. When the engine is shut off and subsequently restarted, the throttle would already be in the WOT position. However, this solution is also unsatisfactory since running the engine at the WOT position for an extended period will cause premature engine wear and may be unsafe.

SUMMARY OF THE INVENTION

An apparatus is disclosed which automatically causes the engine throttle to be in the Wide Open Throttle position at engine starting. The apparatus allows electronic governors powered by alternators to be used in small internal combustion engines, thereby eliminating the need for a battery or manually-operated starting levers in such engines.

The apparatus includes a positioning means connected between the engine throttle and the electronic governor. The positioning means normally changes the throttle position at engine running speeds. The apparatus also includes a first means for automatically causing the positioning means to move in a first direction either when the engine is off or at engine starting speeds to open the throttle. The apparatus includes a second means for automatically overriding the first means at engine running speeds so that the electronic governor operates in the normal fashion at engine running speeds.

In a first embodiment, the positioning means includes a link arm connected between a governor actuator and the throttle. The link arm has a tab which engages a pivotable lever arm at engine starting speeds.

Also in the first embodiment, the first means includes a spring interconnected with the lever arm which pulls the lever arm in a first direction at low engine speeds. The second means preferably includes a centrifugally-responsive flyweight assembly which applies a force to the lever arm that moves the lever arm in a second direction opposite to said first direction at engine running speeds.

At engine starting speeds, the spring force in the first direction is greater than the opposing force resulting from flyweight rotation, thereby causing the lever arm to engage the link arm and to move the throttle to the Wide Open Throttle position. At engine speeds above about 1000 to 1200 RPM, the opposing force in the second direction overcomes the spring force, thereby causing the lever arm to disengage from the link arm. This also disengages the starting system. The electronic governor then outputs control signals to the positioning means to change the throttle position at engine running speeds without interference from the starting system.

In an alternate embodiment, the positioning means includes a first arm or rotor shaft which is part of the actuator and which is directly connected to the throttle. The first means includes a link arm and a pivotable lever arm. The link arm is interconnected between the first arm or rotor shaft and the pivotable lever arm. A spring connected to the lever arm moves the link arm when the engine is off or at low engine speeds to move the first arm or the actuator rotor shaft, thereby opening the throttle. At engine running speeds, a second means including a centrifugally-responsive flyweight assembly engages the lever arm to overcome the spring force, thereby automatically overriding the first means.

The starting system according to the present invention is safer than manually-operated systems wherein the operator moves a lever to a Wide Open Throttle or "Start" position since the operator may fail to thereafter move the lever to the "Run" position. The present starting system is also safer than systems using stepper motors whose position is unknown at engine starting.

It is a feature and advantage of the present invention to provide a system for engine starting that does not require a battery or another external power source.

It is another feature and advantage of the present invention to provide an automatic starting system that eliminates the need for a manually movable start lever.

It is yet another feature and advantage of the present invention to provide a starting system which enables an alternator-powered electronic governor to be used on the engine.

These and other features and advantages of the present invention will be apparent to those skilled in the art from the following detailed description of the preferred embodiment and the attached drawings, in which:

DETAILED DESCRIPTION OF THE PREFERRED EMBODIMENT

Figure 1:
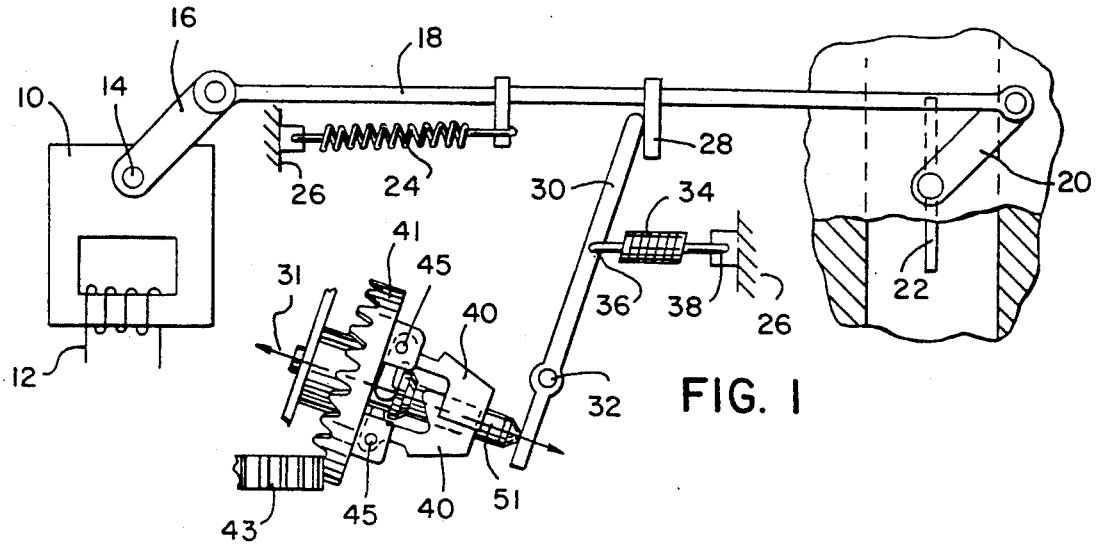
FIG. 1 is a diagrammatic view of a first embodiment of the present invention in the engaged position at engine starting speeds.
Figure 2:
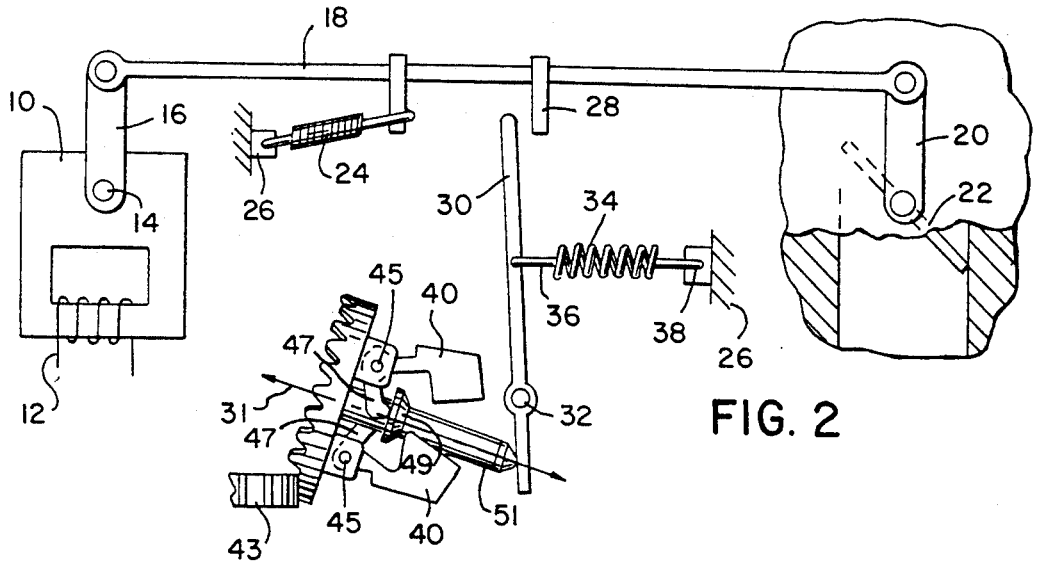
FIG. 2 is a diagrammatic view of the first embodiment in the disengaged position at engine running speeds.

FIGS. 1 and 2 are diagrammatic view of the starting system according to the present invention. FIG. 1 depicts the starting system at engine starting speeds, between about 0 to 1200 RPM. FIG. 2 depicts the starting system at engine running speeds at above about 1200 RPM.

In FIG. 1, the electronic governor includes an actuator 10 having a coil 12 adapted to receive regulated current from an engine alternator in response to a control signal generated by a microprocessor (not shown) of the electronic governor.

When current flows through coil 12, a magnetic flux field is generated such that rotor shaft 14 and thus arm 16 interconnected with rotor shaft 14 are rotated in either a clockwise or a counterclockwise direction. The rotation of arm 16 moves link arms 18 and 20 to thereby change the position of a throttle plate 22.

A return spring 24 has one end connected to link arm 18 and the other end connected to engine frame 26. The spring force of return spring 24 opposes the actuator force of actuator 10, and tends to bias throttle plate 22 to the closed position.

The starting system also includes a tab 28 which extends from link arm 18 and which engages a lever arm 30. Lever arm 30 pivots about pivot 32. A spring 34 has one end 36 interconnected with lever arm 30, and an opposite end 38 connected to engine frame 26. The spring force of spring 34 pulls lever arm 30 in a first direction so that lever arm 30 engages tab 28. Link arm 18 moves in a first direction when lever arm 30 engages tab 28, causing throttle plate 22 to move to the Wide Open Throttle (WOT) position during engine starting.

As depicted in FIG. 2, lever arm 30 disengages tab 28 and link arm 18 at engine running speeds above about 1000 to 1200 RPM. When lever arm 30 disengages link arm 18, the electronic governor and actuator 10 thereof operate without interference from the starting system to position throttle plate 22 in a position determined by the engine set speed.

Lever arm 30 is caused to disengage from tab 28 by centrifugally-responsive flyweights 40. Flyweights 40 are interconnected with a pinion gear 41 which is driven by a drive gear 43. Gear 43 rotates at a speed that is proportional to the engine speed. As engine speed increases, the centrifugal force on rotating flyweights 40 causes the flyweights to move radially outward from their axis of rotation 31. Flyweights 40 pivot about pivots 45 as engine speed increases, causing flyweight legs 47 to engage flange 49 of plunger 51. The plunger pushes lever arm 30, thereby causing lever arm 30 to rotate about pivot 32. At engine running speeds, plunger 51 causes lever arm 30 to rotate in a second direction opposite to the direction of the spring force of spring 34. The centrifugal forces on flyweights 40 cause the spring force of spring 34 to be overridden at engine running speeds, thereby disengaging lever 30 from tab 28. The mass of the flyweights and the spring force of spring 34 are selected so that lever arm 30 disengages from tab 28 at an engine speed above about 1000 to 1200 RPM.

Figure 3:
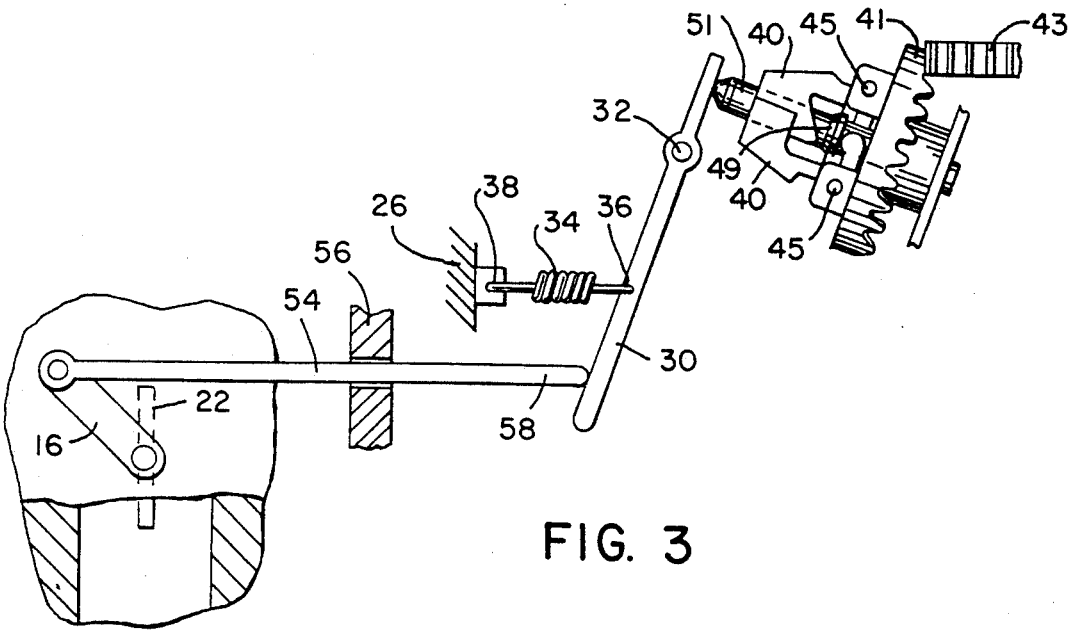
FIG. 3 is a diagrammatic view of a second embodiment of the present invention in the engaged position at engine starting speeds.
Figure 4:
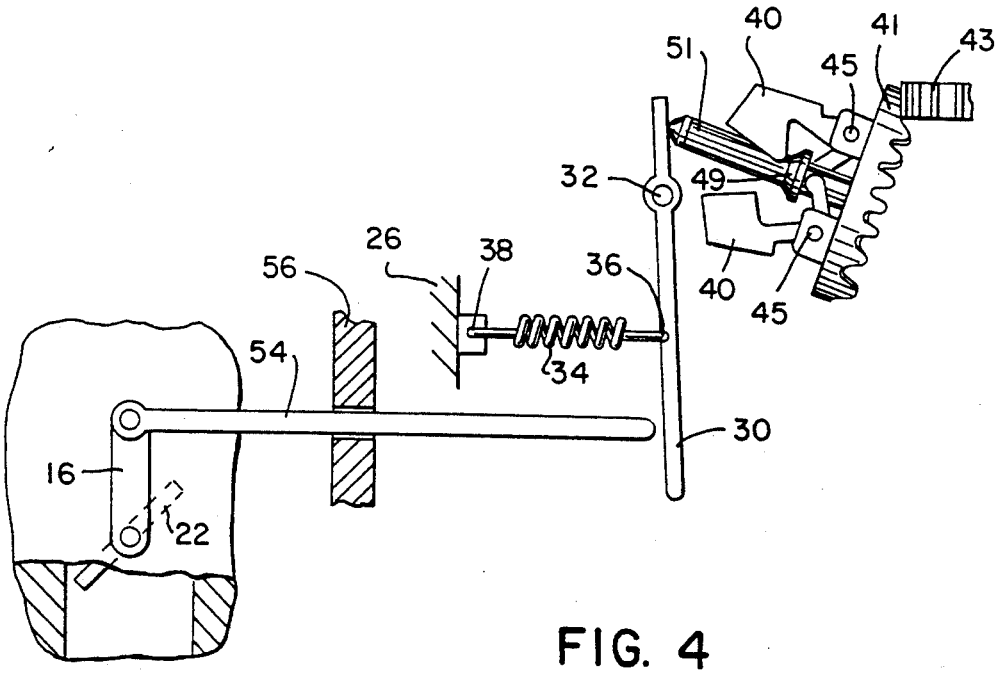
FIG. 4 is a diagrammatic view of the second embodiment in the disengaged position at engine running speeds.

FIGS. 3 and 4 depict a second embodiment of the present invention in which the actuator arm is directly connected to the throttle plate without any intervening linkage. In the alternative, the actuator rotor shaft could be directly connected to the throttle without an intermediate actuator arm. FIG. 3 depicts the starting system in the engaged position at engine starting speeds. FIG. 4 depicts the starting system in its disengaged position at engine running speeds. In FIGS. 3 and 4 as in all the figures, components having corresponding functions have been given the same part designations.

In FIG. 3, actuator arm 16 connected to actuator 10 (not shown) is directly connected to throttle plate 22. Actuator arm 16 is also connected to a link arm 54 which is held in position by a bearing 56. End 58 of link arm 54 is adapted to engage pivotable lever arm 30 when the engine is off or at engine starting speeds. End 58 engages lever arm 30 whenever throttle plate 22 is in the Wide Open Throttle position, as depicted in FIG. 3.

Spring 34 has an end 38 connected to the engine frame 26, and an opposite end 36 connected to lever arm 30. Lever arm 30 pivots about pivot 32. The spring force of spring 34 is selected so that when the engine is off and at engine starting speeds, throttle plate 22 is held in the Wide Open Throttle position. This is accomplished by spring 34 pulling lever arm 30 against end 58 of link arm 54, which in turn moves arm 54. The movement of arm 54 rotates actuator arm 16 to move throttle plate 22 to the Wide Open Throttle position.

At engine running speeds as depicted in FIG. 4, centrifugal flyweights 40 move radially outward, causing plunger 51 to push lever arm 30 in a manner similar to that described above in connection with FIGS. 1 and 2. Lever arm 30 then pivots about pivot 32 so that lever arm 30 is disengaged from end 58 of link arm 54. The starting system is thus disengaged at engine running speeds. Once the starting system is disengaged, the actuator and its actuator arm 16 are free to position throttle plate 22 in the position dictated by a control signal from the electronic governor, as discussed above.

Other means may be used to override the starting system in place of the centrifugally-responsive flyweight assembly, such as an air vane governor or an electric solenoid. Like the flyweight assembly, such other means rotate lever arm 30 at engine running speeds so that arm 30 disengages the throttle positioning means at engine running speeds.

Figure 5:
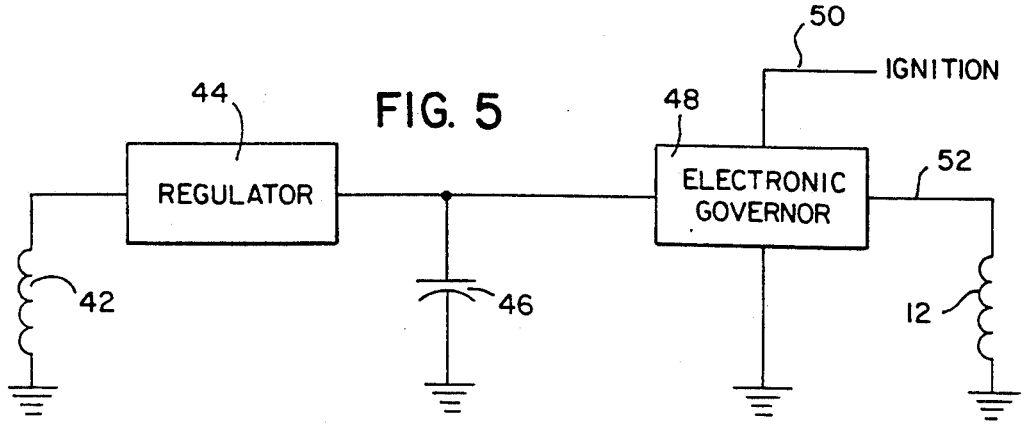
FIG. 5 is a block diagram of an engine governor circuit which may be used with any of the embodiments of the present invention.

FIG. 5 is a block diagram of the electronic governor circuit that may be used with any of the embodiments of the present invention. In FIG. 5, a rotating magnet (not shown) generates an alternating current in a coil of alternator 42. This alternating current is then regulated by a regulator 44. The regulated current output from regulator 44 is filtered by a large filter capacitor 46 and is then input to an electronic governor 48. Electronic governor 48 also senses the ignition firings from the ignition system via line 50 so that governor 48 may determine the engine speed. If the actual engine speed differs from the engine set speed, electronic governor 48 generates a control signal on line 52 which controls the current through actuator coil 12. As discussed above in connection with FIGS. 1 and 2, the current through coil 12 determines the position of rotor 14, and thus the throttle position at engine running speeds.

The starting system described above has been designed to disengage at about 1200 RPM. This value was chosen since above about 1200 RPM, the alternator and the regulator generate enough power to operate the electronic governor. However, other cutoff speeds may be used, depending upon the particular application.

Although the starting system is preferably used with an electronic governor, the starting system may also be used in engines having mechanical governors, or which have other mechanical or electronic devices for limiting engine speed.

While several embodiments of the invention have been shown and described, other embodiments will be apparent to those skilled in the art and are within the intended scope of the present invention. Therefore, the invention is to be limited only by the following claims.

I claim:

1. A starting apparatus for an engine having an electronic governor and a positionable throttle, comprising:

positioning means for changing throttle position at engine running speeds in response to said electronic governor, said positioning means including a movable link arm;

a pivotable lever arm that moves said link arm when said engine is off or at engine starting speeds to override said positioning means and thereby open said throttle; and speed responsive means for pivoting said lever arm at engine running speeds so that said lever arm does not substantially affect the movement of said link arm at engine running speeds.

2. The starting apparatus of claim 1, wherein said positioning means includes an electromagnetic actuator.

3. The starting apparatus of claim 1, wherein said link arm includes a tab that engages said lever arm when said engine is off or at engine starting speeds.

4. The starting apparatus of claim 1, further comprising:

means for biasing said lever arm to a first position when said engine is off or at engine starting speeds.

5. The starting apparatus of claim 4, wherein said biasing means includes a spring interconnected with said lever arm.

6. The starting apparatus of claim 1, wherein said speed responsive means includes a centrifugally-responsive flyweight assembly that applies a force to said lever arm at engine running speeds.

7. The starting apparatus of claim 6, further comprising:

means for applying a biasing force to said lever arm that opposes said force of said flyweight assembly.

* * * * *